United States Patent [19]

Vural

[11] Patent Number: 4,534,419

[45] Date of Patent: Aug. 13, 1985

[54] METHOD FOR PILE DRIVING AND DRAGGING

[75] Inventor: Gülertan Vural, Emmelshausen, Fed. Rep. of Germany

[73] Assignee: Koehring GmbH, Boppard, Fed. Rep. of Germany

[21] Appl. No.: 926,228

[22] Filed: Jul. 20, 1978

[30] Foreign Application Priority Data

Jul. 21, 1977 [DE] Fed. Rep. of Germany ..... 2732934

[51] Int. Cl.[3] ..... E02D 7/10; E02D 7/18

[52] U.S. Cl. ..... 173/1; 173/10; 173/12; 173/115

[58] Field of Search ..... 173/1, 10, 12, 115; 91/217

[56] References Cited

FOREIGN PATENT DOCUMENTS 1484428 12/1968 Fed. Rep. of Germany ..... 173/1

1759145 10/1971 Fed. Rep. of Germany .

*Primary Examiner*—Robert R. Mackey

*Attorney, Agent, or Firm*—Spencer & Frank

[57] ABSTRACT

A method and apparatus for guiding a body into the ground by means of a single hammer acted on by a reaction mass which is driven by a double-acting piston-cylinder unit via a controlled, periodically changing stream of pressure medium and which generates forces which act on the body in its longitudinal direction, the body being driven by first causing the pressure stream to have an approximately sinusoidally pulsating form for imparting a vibratory movement to the hammer, and then, when the speed with which the body is being driven into the ground decreases below a given minimum value, causing the pressure medium to drive the reaction mass according to a periodic, approximately unsteady displacement-time function for imparting a hammering movement to the hammer, while, during such hammering movement, simultaneously monitoring the hammering energy being generated.

8 Claims, 2 Drawing Figures

METHOD FOR PILE DRIVING AND DRAGGING

BACKGROUND OF THE INVENTION

The invention relates to a method for driving material such as piles or the like into the ground with the aid of a single hammer which is driven by a double-action piston-cylinder unit via a controlled periodically changing stream of pressure medium and which in the driven material induces forces in the longitudinal direction.

The method of driving a pile, a sheet pile or the like into the ground by striking it with the aid of a hammer is known. In this case, the hammer is either raised mechanically and the striking energy is transmitted to the material being driven in by the falling energy of the hammer or, as disclosed in U.S. Pat. No. 2,731,796, the hammer is raised by means of hydraulic oil and is accelerated for the driving stroke in the direction toward the material to be driven in by a hydraulic fluid under pressure, so that in addition to the falling energy of the hammer the actuated pressure energy is converted to striking energy. Such hammer driving is connected with considerable noise development so that additional measures must be taken with respect to noise protection. Moreover, the striking frequency and thus the driving speed is limited.

Recently it has been attempted, instead of striking with a hammer, to vibrate the material into the ground. The vibratory energy is generally generated either by so-called eccentric vibrators or is transmitted to the material to be driven in by hydraulic means with the aid of a pulsating stream of pressure medium. Although vibrating the material has the advantage of considerably less noise development it does have a series of drawbacks. For example, it may happen that after reaching a certain penetration depth for a driven pile, the pile is jammed tight and further penetration of the pile is impossible even with a change in frequency and/or amplitude, although the required penetration depth has not yet been reached. A further drawback of vibrating is that for so-called pile grillage foundations, where proof of load-carrying capability has to be given, this cannot be effected by the driving device, as for example during hammer driving, but that an additional measuring instrument must be provided or the vibratory tool must be exchanged and the last piece of the penetration has to be effected with the aid of a hammer so as to provide the proof of load carrying capability. Exchanging the vibration device for a striking device is also necessary if, as described above, the material being driven in "jams" without having reached the required penetration depth.

The drawbacks of vibrating require either the use of an overdimensioned vibratory device where in a number of cases the proof of load carrying capability must be made with a special testing device or by subsequent hammer driving, or, if a "normally" dimensioned vibratory device is used, a second driving device must be used in any case if the material to be driven in is "jammed", be it a heavier vibratory device or a driving hammer. A further drawback is that upon "jamming" of the material with subsequent shut-off of the energy supply, it requires a substantially greater amount of energy to reinstate the driving process in order to overcome the counteraction of the earth that has settled down in the meantime, so that in addition to the costs for maintaining and assembling a second driving device, there exist, depending on the consistency of the ground, further difficulties with respect to further penetration of the material into the ground.

SUMMARY OF THE INVENTION

It is now the object of the invention to provide a method with which the above-described drawbacks can be avoided.

This is accomplished in that the initially approximately sinusoidally pulsating stream of pressure medium is regulated so that, when the penetration speed of the material being driven in drops to below a given minimum value, the movement of the reaction mass follows a periodic, approximately unsteady path-time function, particularly a sawtooth or rectangular function and that upon transition to the hammering mode of operation the striking energy expended is simultaneously determined. This method has the advantage that the material is driven into the ground with hammer strokes even before there is an indication of "jamming" of the material being driven in, that is before the forces counteracting the driving action stop the material by settling the earth, practically while the movement is still going on, so that a given path-time function for the reaction mass during the hammering mode of operation can produce optimum adaptation of the energy supply to the consistency of the ground. The transition from the vibrating to the hammering mode of operation can be determined, for example, by measuring the pressure in the upper and lower cylinder chambers. A decrease in effective power or an increase in blind power, respectively, at the end of the vibrating phase can be derived from the difference in pressure and from a drop in pressure. Since the transition to the hammering mode of operation generally takes place on the last part of the intended penetration depth, there simultaneously exists the possibility of effecting determination of load carrying capability via the determined striking energy.

In one embodiment of the method according to the invention, the striking energy is determined from the velocity of the reaction mass shortly before impact. Since the size of the reaction mass is known, it is thus very easy to determine the kinetic energy of the reaction mass as converted into striking energy. This can either be done in that the path-time function of the reaction mass during the "hammering stroke" is measured and its velocity is determined in a subsequently connected computer or in that a velocity sensor connected with the reaction mass determines the velocity directly or the striking force is indicated directly by means of an accelerometer which is connected with the reaction mass. Since with predetermined path-time functions for the reaction mass it is advisable to provide a control device to control the stream of pressure medium during striking operation, a corresponding function generator being associated with the control device, the above-described various ways of determining the striking energy can be realized in a simple manner which is also applicable to the practice under the rough conditions of a construction site.

According to another embodiment of the invention, it is provided that the striking energy is determined indirectly via the hydraulic pressure in the operating cylinder which acts on the reaction mass during the striking movement. The mechanically provided data, such as the reaction mass, piston surface area, friction losses, etc. under consideration of an average operating pressure during the striking movement, permit a sufficiently accurate determination of the striking energy.

In a further embodiment of the invention, it is also provided that during hammering operation the unsteady path-time function which is determinative for the movement of the reaction mass has superposed on it a preferably sinusoidal movement function at a higher frequency by means of an additional pulsation of the stream of pressure medium. This has the advantage that during the time period between every two strokes, i.e. when the reaction mass is being lifted by means of the piston-cylinder unit, a vibratory movement is introduced in the driven material due to the pulsation of the pressure medium stream which has been superposed on the rising movement. Under the given circumstances, this vibratory movement generally will not cause the material to be driven in any further but it is sufficient to keep the earth surrounding the driven material, for example a pile, in motion so that the friction forces which must be overcome during the next stroke will not be increased as a result of settling of the ground.

In one embodiment of the method according to the invention it is further provided that the given path-time function for the relative movement between the reaction mass and the piston is generated in that the control valve is controlled with the aid of a preferably adjustable function generator.

As a further feature of the method according to the invention it is finally provided that for vibratory operation a minimum value is given for amplitude or frequency of the relative movement between reaction mass and piston and that, when this minimum value has been reached, the control valve is actuated by means of the control device so that the respective other value of the relative movement is varied. This automatically adapts the operating parameters so that premature "jamming" is prevented in that it can still be avoided by making this change and simultaneously the limits set by the available stream of pressure medium are considered by the establishment of the minimum value for that parameter (amplitude or frequency) which has priority in the respective application.

The invention further relates to an apparatus for practicing the method of the invention, comprising a supporting frame which can be suspended from a lifting tackle and is connected with a piston-cylinder unit connected via a controllable valve to a pressure medium supply, the cylinder of this unit being connected with a reaction mass and the piston being connectable with the driven material via a piston rod. Associated abutment elements are provided at the piston rod and at the reaction mass at least on the side facing the driven material. The basic structure of pile driving devices of this type—hereinafter this term is intended to include vibrating as well as striking devices—is disclosed in the already mentioned U.S. Pat. No. 2,731,796 or in German Offenlegungsschrift No. 1,759,145. However, the prior art devices are designed either for purely vibratory operation or for purely hammering operation.

It is therefore the object of the invention to provide a driving device which makes it possible to vibrate the material in as well as to hammer it in, the same device being operatable in a purely vibratory mode or in a purely hammering mode. In particular, the apparatus according to the invention is to make it possible to combine both modes for the respective driving process in such a manner that preferably the vibratory mode is used first and when a minimum penetration velocity has been reached by the driven material a change is made directly to the hammering mode without any change in equipment.

This is accomplished by the invention in that for an apparatus of the above-mentioned type the piston is elastically suspended from the supporting frame by means of a piston rod which protrudes from the top of the cylinder, that a hydraulic reservoir is fastened to the supporting frame and is in communication, on the one side, via a feeder line with the pressure medium supply and on the other side, via a flexible feeder line, with a control valve, that the control valve is in communication with a control unit and that a signal generator is preferably connected with the reaction mass whose signal output is in communication with the control unit. A driving device of such design permits not only a selection between vibratory or hammering operation but also a combination of the two modes of operation, the arrangement of the signal generator being determinative for the time of change during the driving process from vibratory to hammering operation without stopping. The hydraulic reservoir is here disposed ahead of the control valve when seen in the direction of flow of the pressure medium, so that it performs a dual function, namely during vibratory operation it smoothes the pressure medium pulsation created in the pressure medium feeder line by means of the control valve and on the other hand during hammering operation it makes available the quantity of pressure medium which is under high pressure and is required for short periods of time thus imparting a high degree of acceleration to the reaction mass as required for the hammering operation. Since the hydraulic reservoir constitutes a large mass, the mass ratio between hammer and driven material required for the driving process is adversely influenced. Due to the built-in movable parts, the hydraulic reservoir constitutes a component which is sensitive to vibration so that its fastening to the supporting frame, which is shielded from the vibrating or hammering parts, respectively, by elastic means, offers good protection. Moreover, the reaction movements of the piston rod are not transmitted to the lifting tackle. It must here be considered that accelerations up to 200 g may occur. The piston-cylinder unit is designed to be a double acting unit with both piston faces being of the same size.

One feature of the apparatus according to the invention is that the signal generator is designed as a path sensor and is disposed between the piston rod and the reaction mass. This positioning of the signal generator is not only structurally simple for reasons of construction, it also permits the use of relatively robust devices which are not very prone to malfunction so that a long service life can be expected of the signal generator. According to another advantageous feature of the invention, it is provided that the signal generator is designed either as velocity sensor or as acceleration sensor.

In a further feature of the apparatus according to the invention it is provided that a preferably adjustable pressure sensor is disposed in the feeder line to the hydraulic reservoir and can be connected with the control unit for hammering operation. With such a pressure sensor it can be assured that during the hammering mode the control valve will be opened by the control unit only if after each stroke the given precharge pressure of the pressure medium is actually present so that each stroke is performed with the maximum possible hydraulic pressure and a sufficient quantity of pressure medium.

It is of particular advantage if the elastic suspension of the piston rod at the supporting frame is set to be soft for a movement toward the driven material and hard in the opposite direction and that the piston rod is tensioned against the hard portion of the elastic suspension. This arrangement has the advantage that the rapid downward movement of the piston rod which is firmly connected with the driven material, particularly during the hammer driving mode, is practically not braked at all and no noticeable counter forces emanating from the supporting frame, which in any case must be considered stationary, obstruct the downward movement. On the other hand, the bias against the hard portion of the suspension permits secure positioning of the total pile driving device. In particular, "tipping" of the supporting frame with respect to the parts which are permanently connected with the piston rod is prevented during transport etc.

A further feature of the invention provides that the reaction mass and/or the supporting frame are provided with means for fastening additional masses. This makes it possible to provide a larger "field of action" for each pile driving device for various applications since the arrangement of additional masses makes possible an increase in the available driving energy, be it for vibration or for hammering operation. This is of particular advantage when the pile driving device is used in conjunction with a controllable pressure medium supply. The vibratory driving can often be advantageously supported by an additional weight which is resiliently connected with the supporting frame.

As a further advantageous feature of the apparatus according to the invention it is provided that the reaction mass has the shape of a beam. This design makes it possible, with a corresponding longitudinal extent of the reaction mass, to keep the mass small enough that, for example, in an already driven-in sheet pile, individual piles can be driven in deeper than the respective adjacent piles as the reaction mass, due to its narrow width, can freely move in the resulting gap.

In a further feature of the apparatus according to the invention it is provided that at least one guide bolt is disposed between the reaction mass and the piston member to act as a safety against rotation. This assures secure guidance of the relative movement between reaction mass and piston member so that even with large-dimension pile driving devices of the type according to the invention operation can be effected with but a single piston-cylinder unit. A further advantage becomes evident if, according to the invention, the hollow guide bolt simultaneously encloses the path sensor and thus protects it against damage. When appropriately designed, the guide bolt can directly sense the relative movement between the reaction mass and the piston member.

A BRIEF DESCRIPTION OF THE DRAWINGS

The invention will be described in detail with the aid of schematic drawings of one embodiment wherein.

DESCRIPTION OF THE PREFERRED EMBODIMENTS

Figure 1:
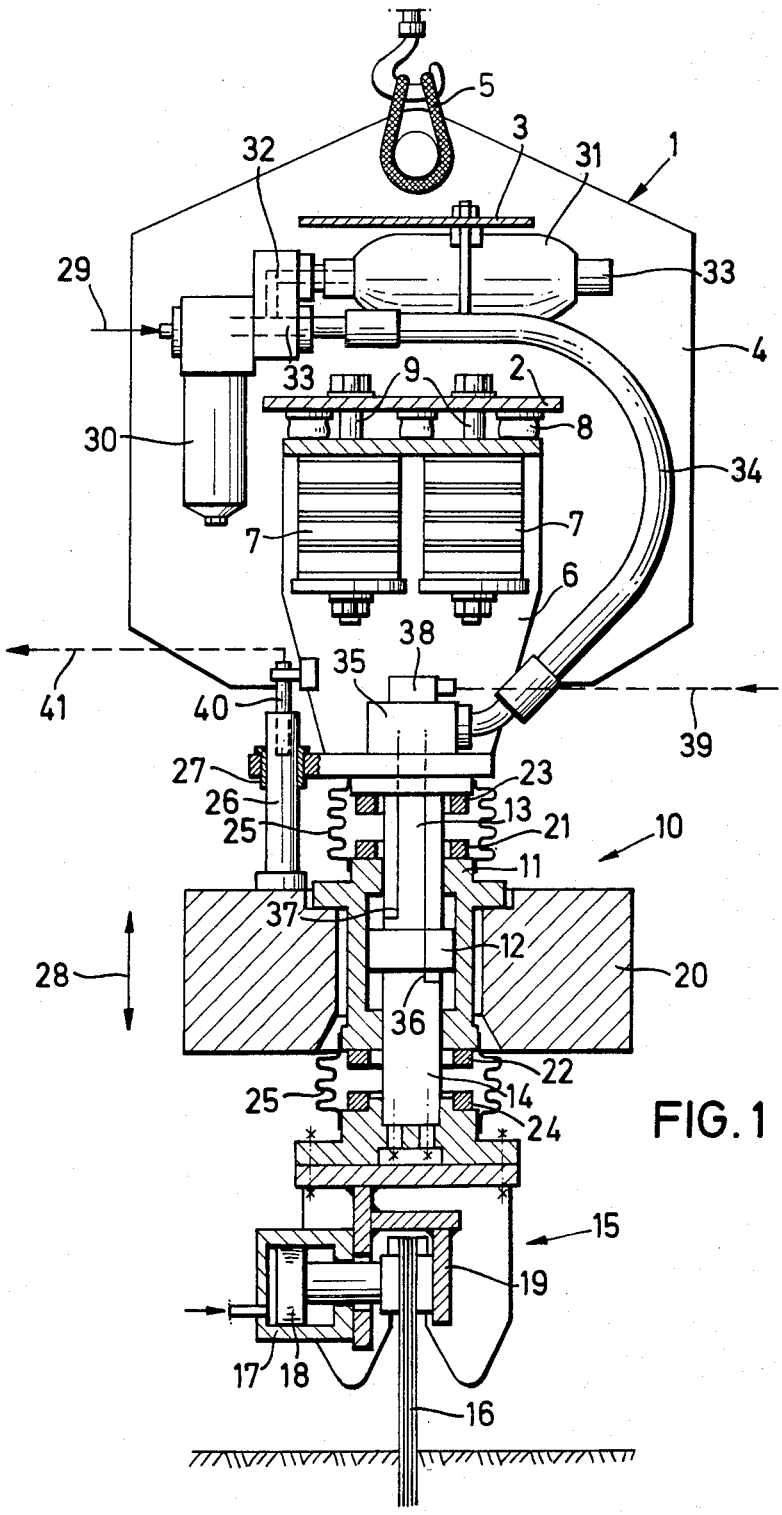
FIG. 1 represents a driving device according to the invention, partially in section.

The pile driving device includes a supporting frame 1 which essentially comprises two side jaws 4 which are rigidly connected together by means of bars 2, 3. This supporting frame 1 may be held by appropriate fastening means 5 to be raisable and lowerable in the conventional manner.

The operating part of the driving device is fastened, to bar 2 via a supporting yoke 6 and the intermediary of spring elements 7, 8. The elastic elements, for example, rubber springs, are designed so that the rubber springs 7 are very soft while the rubber springs 8 which are connected to the transverse support 2 are hard and serve merely to essentially keep the shocks produced by the operating portion of the driving device away from supporting frame 1. Tension screws 9 hold the supporting yoke 6 against the rubber buffers 8 and at the same time tension the rubber springs 7 in the desired manner.

The operating portion 10 of the pile driving device essentially comprises a cylinder 11 in which a piston 12 is disposed for double acting operation. The piston 12 is provided at the top with a piston rod 13 and at the bottom with a piston rod 14 which protrude from both sides of cylinder 11. The upper piston rod 13 is rigidly connected with supporting yoke 6 while at the lower piston rod 14, a holding jaw 15 for fastening the material 16 to be driven in, for example, a sheet pile, is fastened. The holding jaw 15 may be of any known structural design. In the illustrated embodiment, it is designed as a hydraulic jaw in which a piston 18 is pressed against a stationary abutment 19 by means of a cylinder 17 and a pressure medium.

A reaction mass 20 is fastened to cylinder 11. This reaction mass may have an annular shape or, in a preferred embodiment thereof, a beam shape. In the illustrated embodiment, the beam-shaped reaction mass would have a longitudinal axis, i.e. its largest expanse, in the direction of the plane of the drawing so that in the direction of the transverse axis perpendicular to the plane of the drawing the reaction mass would not protrude to either side of the holding jaw 15.

Abutment elements 21, 22 are fastened at the top as well as at the lower end of cylinder 11, with corresponding abutment elements 23, 24 being mounted at the supporting yoke 6 and at the holding jaw 15, respectively. A bellows 25 seals each end of the piston rod 13, 14 protruding from the cylinder in a dust-tight manner, the bellows producing a not insignificant sound proofing effect.

On the upper side of the reaction mass 20, there is fastened a guide bolt 26 which passes through a guide sleeve 27 fastened to the supporting yoke 6 so that the cylinder 11 with the reaction mass 20 fastened thereto cannot rotate with respect to the piston 12, but a relative movement can be performed in the direction of the double arrow 28 between cylinder and piston.

The pressure medium feeder line indicated by arrow 29 initially opens into an oil filter 30 which is fastened to the supporting frame. On the discharge side of the oil filter, the pressure medium line branches off and leads, on the one hand, to a hydraulic reservoir 31 of conventional design which is fastened to bar 3. The hydraulic reservoir, for example, is designed so that a rubber bladder is held in a pressure-tight vessel, the interior of the bladder being in communication with the branch line 32 of the pressure medium line. This bladder can be charged with a gas, generally nitrogen, from the outside through a schematically indicated feeding valve 31', so that a quantity of pressure medium, generally pressure oil, corresponding to the capacity of the rubber bladder can be made available under the pressure provided by the gas. Additionally, gas losses produced by diffusion processes or the like, can be replenished.

The other branch 33 of the pressure medium line emanating from filter 30 opens into a flexible hose 34 through which a control valve 35 can be supplied with pressure medium.

A line 36, schematically indicated in the drawing, passes from the control valve through the shaft of the piston rod 13 into the lower cylinder chamber and a line 37 into the upper cylinder chamber. By means of a schematically indicated control drive 38 of conventional design which receives its control pulses, for example electrical pulses, through a corresponding line 39, the control valve 35 is actuated corresponding to the given operating program so that the lower as well as the upper cylinder chamber can be charged with the pressure medium.

In the illustrated embodiment, the guide bolt 26 is hollow in part so that a signal generator in the form of a path sensor 40 connected with the supporting yoke 6 extends into the bore of the guide bolt 26. The movable part of the path sensor 40 which operates capacitively, inductively or potentiometrically, receives its input in bolt 26. The relative movement between piston and cylinder is measured and fed, via a signal line 41, to a control device which will be explained below.

Figure 2:
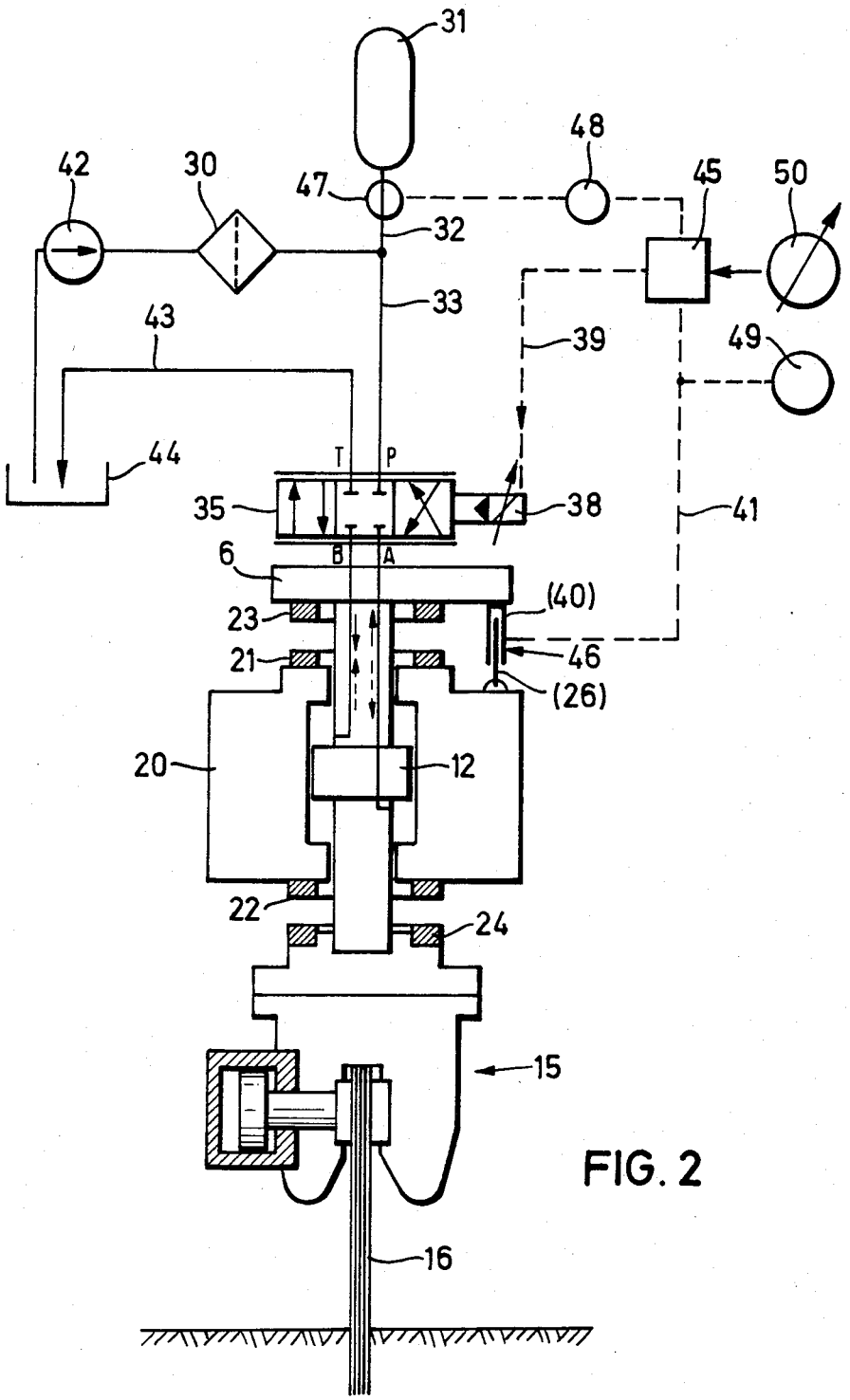
FIG. 2 represents a flow and control diagram to explain the method according to the invention.

FIG. 2, in the form of a flow scheme, illustrates in detail the pressure supply and the control device. Electrical signal connections are shown in broken lines. The same reference numerals were used in FIG. 2 for those components which have already been described in connection with FIG. 1.

The supply with pressure medium is effected by means of a preferably regulatable pressure pump 42 which supplies the pressure medium, generally oil, via filter 30 and feeder line 33 to the control valve 35. The pressure medium is discharged from control valve 35 via a line 43 which opens into a pressure medium reservoir 44 from which the pressure medium pump 42 is supplied.

The control drive 38 for the control valve 35 is connected with a control device 45 via control line 39. The path sensor 40 for determining the relative movement between piston 12 and reaction mass 20, which in the illustrated embodiment is disposed in the guide bolt 26, is likewise connected with the control device 45 via signal line 41.

In order to practice the method according to the invention, the driving device operates as follows:

Once the material 16 being driven in, for example a sheet pile or a driven pile, has been firmly connected with the driving device by means of the holding jaw 15 and has been placed onto the ground at the intended location, and the pressure medium is supplied to the control valve 35 under a given pressure through feeder line 33, control drive 38 is actuated by control device 45 at a given frequency so that alternatingly the lower and the upper cylinder chambers are supplied with pressure medium. The pulsation of the pressure medium fed to the cylinder approximately corresponds to a sine curve. Due to this pulsation which takes place at a relatively high frequency, for example 50 Hz, the vibratory system including the piston 12 and the holding jaw 15 is caused to vibrate while, due to the resiliency of the earth on the one hand and the size of the reaction mass on the other hand, the reaction mass 20 can be considered to be practically stationary while the piston is moved corresponding to the pulsation frequency so that longitudinally oriented vibrations are transmitted to the driven material in correspondence with the pulsation frequency and thus cause it to penetrate into the ground. Corresponding to the penetration speed, the entire pile driving device is gradually lowered by the lifting tackle which is connected with the holding means 5 (FIG. 1). The amplitude of the relative movement between piston and reaction mass can be continuously monitored by the path sensor 40.

With increasing penetration depth and correspondingly increased friction resistance, the penetration speed generally decreases until, in spite of further vibration, the driven material "jams" and no longer penetrates into the ground. Since mainly for noise protection reasons the material is to be driven in as long as possible with the aid of vibrations, there now exists the possibility of monitoring the frequency to amplitude ratio with the aid of the signal generator and to either continuously change the frequency in dependence on the measured amplitude or to set a minimum amplitude and change the frequency accordingly when this minimum amplitude is reached so that practically at every point in time operation takes place with the determined optimum frequency to amplitude ratio.

While for material which is not to undergo any vertical stresses, for example, sheet piles or the like, the only important thing is the penetration depth; for vertically stressed material, for example driven piles in a pile grillage foundation, the pile must be driven far enough into the ground that it will not sink in any further under a test load which is greater than the operating load intended for the pile. It has now been found in a plurality of applications, corresponding to the respective, locally changing consistency of the ground, that these prerequisites cannot be realized by means of vibration only. In order to obtain an optimum result for these cases in particular, the total device illustrated in FIG. 2 is designed so that upon a drop in the penetration speed of the driven material 16, which may be realized, for example, by continuously measuring the lowering speed of the lifting tackle 5, or from a neutral reference point when a minimum penetration speed has been reached, the control device 45 actuates the control valve 35 in such a manner that the reaction mass 20 is raised approximately to the level of the upper abutment element 23 and is then reversed and moved downward at full available hydraulic pressure so that the reaction mass abuts at the lower abutment element 24 at the holding jaw 15 with a greater speed, i.e. with a motion energy which is large corresponding to the size of the reaction mass. Upon completion of the impact, the control valve is again actuated so that the reaction mass is raised and upon reaching the upper abutment is moved downward toward the abutment element 24 at full pressure. In this way, there is provided a smooth transition from the purely vibratory mode of operation to the hammering mode of operation, the reversal period being so short that the ground has not settled sufficiently after the preceding vibrating mode to cause the pile to jam but that the hammering mode is continued at once.

While in the vibratory mode of operation the hydraulic reservoir 31 only serves the purpose of absorbing and smoothing the recoils produced in line 33 by switching of control valve 35, in the hammering mode of operation the hydraulic reservoir serves as additional pressure medium reserve so that a quantity of pressure medium is available which exceeds the conveying output of the pressure medium pump 42 and which is under high pressure. This makes it possible to greatly accelerate the reaction mass during the "hammer stroke" so that a high striking energy is available. During the "return stroke" which is somewhat slower, the reservoir 31 can fill up again thus having a sufficient pressure medium reserve available at all times. If a pressure monitor 47 is provided in the area of the branch line 32, it can be assured that the highly pressurized pressure medium reserve required for the "hammer stroke" cannot drop as a result of complete depletion of the reservoir. If during hammering operation over a longer period of time the hydraulic reservoir 31 should become completely empty, the pressure in the branch line 32 will drop below a certain value as a result of the lack of a quantity of pressure medium. If a corresponding low pressure signal is fed by monitor 47 to a regulator 48 which is in communication with the control device 45, the hammering frequency can be reduced to provide sufficient time during the return stroke to replenish the hydraulic reservoir.

Since, in particular for pile grillage foundations, the expended striking energy must be documented, the method according to the invention permits continuous monitoring of the expended striking energy during operation. If, for example, the signal generator 40 is designed as a path sensor, the signal applied via signal line 41 can be used in a small computer 49 to determine directly from the path-time function of the reaction mass as determined by the signal generator 40 the velocity of the reaction mass. If the other data of the device are additionally fed into the computer, particularly the size of the reaction mass, a display or recording device can be used to directly indicate the striking energy or the striking force.

The design of the signal generator 40 as path sensor has the additional advantage that the exact position of the reaction mass with respect to the center plane of the piston 12 can be determined. This makes it possible to define a zero position of the reaction mass 20 with respect to the center plane of the piston so that, for example during vibratory operation, the position of the reaction mass with respect to this zero position can be continuously monitored. If during the vibratory operation the reaction mass slowly decends relative to the piston as a result of pressure medium losses at the point of passage of the piston rod 14 through the cylinder wall, the reaction mass will come to rest on the lower abutment element after some time. This effect, which has been noted in the prior art hydraulic vibratory devices, has the result that at this moment vibration ceases completely and thus the driven material either comes to rest or is struck uncontrollably. If after an appropriate control measure and raising of the reaction mass into its normal operating position, work is resumed, it may quite possibly happen that the pile has already "jammed" although with further uninterrupted vibration a greater penetration depth could have been realized. Often the added vibratory device is then no longer able to produce the required energy necessary to overcome the friction resistance and to drive the pile further into the ground.

Since in the apparatus according to the invention every deviation of the reaction mass from the zero position can be determined at once, it is possible, by means of an appropriate control signal generated by the control unit 45, to influence the control valve 35 in such a manner that a somewhat larger stream of pressure medium is fed to the cylinder during every upward stroke than during the downward stroke so that the occurring oil leakage losses are compensated and the intended zero position is automatically resumed. This advantage can be realized only if the control element, the piston-cylinder unit, the signal generator and the control unit form a "closed" control circuit which permits such automatic resetting. The actuation of this control measure can be effected within the control unit either by appropriate electronic or electrical components of conventional design or by means of the additional element 49 identified as a "computer". The determination of the zero position is effected, since during vibratory operation the relative movement between piston and reaction mass is approximately sinusoidal, by a displacement of the zero line of the sinusoidal vibration actually recorded compared to a given zero line which in the illustrated embodiment, for example, can be given by the spatial association of guide bolt 26 and sensor 40.

It is particularly expedient for the control device 45 to have an associated function generator 50 through which the desired path-time functions for the relative movement between reaction mass 20 and piston 12 can be given. This can be done, for example, for vibratory operation by giving a corresponding sine function where the sine function produced by the function generator constitutes the desired curve while the signal generator 40 which is designed as path sensor determines the actual curve so that at a drop in amplitude the function generator can influence the operating frequency. This can be done automatically or in the form of a so-called two-point regulation.

While the generation of a sine function can also be produced by other means, for example mechanically via a rotating control disc, the use of a function generator offers the advantage, particularly for hammering operation, that an optimum path-time function can be given to adapt the system to the respective ground conditions and to control the movement of the reaction mass which is now being hammered. Such functions can be given, e.g., as sawtooth functions or rectangular functions. It must be considered, however, that even if an exact rectangular function is given, the actual movement of the reaction mass will correspond only approximately to a rectangular function due to the inertial forces that must be overcome. The same applies for a corresponding sawtooth function.

The use of a function generator has the further advantage that even during hammering operation a pulsation can be impressed with simple means on the stream of pressure medium so that the material 16 to be driven in is subjected to a vibratory force even during the return stroke of the reaction mass so that the earth surrounding the driven material does not come to rest during this time as well and even smaller dimensioned devices are able to produce greater penetration depths and greater load carrying capabilities, for example, for a foundation pile. With the appropriate design of the control valve 35, the additional pulsation of the pressure medium can be generated directly by the control valve so that, for example during the return stroke, the control spool of the control valve oscillates even in the "open" state and thus produces the corresponding pulsation of the pressure medium.

Although the most advantageous embodiment for the signal generator is the design as path sensor, it may be advisable, depending on the project at hand for the pile driving device, to design the signal generator as a velocity sensor or as an accelerometer or to provide such sensors in addition. If a "computer" 49 is combined with the control device the resulting signals can be made available in every case in the form required for regulation by means of the control and regulating device.

The operation of the apparatus has been described above for driving in material. With the appropriate actuation of the control valve 35, the apparatus can also be used for "dragging", for example, of sheet piles. In this case, the system operates initially in a hammering mode with the simultaneous application of tension by means of the lifting tackle. The control valve 35 is here actuated in such a manner that the "hammering stroke" is directed upwardly, i.e. the reaction mass strikes against the abutment element 23 while the "return stroke" is directed downwardly. As soon as the pile 16 has been loosened sufficiently, the system can be switched to vibratory operation and the pile can be completely pulled out with the aid of the lifting tackle.

I claim:

1. A method for driving a body into the ground by means of a single hammer which is driven by a double acting piston-cylinder unit supplied with a controlled, periodically changing stream of pressure medium and which generates forces which act on the body in its longitudinal direction, the piston-cylinder unit including two parts movable relative to one another under the influence of the pressure medium, with one of the parts being secured to the hammer and the other of the parts being secured to a reaction mass, comprising: initially causing the pressure stream to have an approximately sinusoidally pulsating form for imparting a vibratory movement to one part and the hammer; relative to the other part; monitoring the relative movement between the two parts; when the speed with which the body is being driven into the ground decreases to below a given minimum value, causing the pressure medium to be controlled to displace the other part and the reaction mass relative to the one part according to a periodic, approximately unsteady displacement-time function for causing the reaction mass to apply a hammering movement to the hammer; and during occurrence of such hammering movement, simultaneously determining the hammering energy being generated.

2. The method as defined in claim 1 wherein said step of determining the hammering energy is carried out by measuring the velocity of the reaction mass shortly before its impact with the hammer.

3. A method as defined in claim 1 or 2 wherein the pressure medium is delivered to the piston-cylinder unit via a control valve operated by a control device, and said step of initially causing the pressure stream to have an approximately sinusoidally pulsating form is carried out in a manner to cause the piston of the piston-cylinder unit to undergo vibratory movement relative to the reaction mass and comprises varying the minimum value of one of the amplitude and frequency of the relative vibratory movement, by means of the control device, when the other of the amplitude and frequency reaches a given minimum value.

4. A method as defined in claim 1 wherein said step of determining the hammering energy is carried out indirectly by monitoring the pressure in the cylinder of the piston-cylinder unit acting on the reaction mass during the hammering movement.

5. A method as defined in claim 1 further comprising, during occurrence of such hammering movement, superimposing on the periodic, unsteady displacement-time function, an additional pulsation of the stream of pressure medium at a frequency higher than the repetition rate of the periodic function.

6. A method as defined in claim 1 wherein the periodic displacement-time function is produced by driving a control valve supplying pressure medium to the piston-cylinder unit under control of a function generator.

7. A method as defined in claim 1 wherein the body is a pile.

8. A method as defined in claim 1 wherein the periodic displacement-time function has a sawtooth or rectangular form.

* * * * *